United States Patent [19]

Monzo

[11] Patent Number: 4,753,696

[45] Date of Patent: Jun. 28, 1988

[54] METHOD OF MAKING A WATER MATTRESS WITH HYDRAULIC CHAMBER ASSEMBLY

[75] Inventor: George R. Monzo, Huntington Beach, Calif.

[73] Assignee: American National Watermattress Corporation, Anaheim, Calif.

[21] Appl. No.: 25,284

[22] Filed: Mar. 12, 1987

Related U.S. Application Data

[62] Division of Ser. No. 728,761, Apr. 30, 1985, abandoned.

[51] Int. Cl.[4] ..... B32B 31/20

[52] U.S. Cl. ..... 156/145; 5/441; 5/450; 5/455; 156/210; 156/292; 156/308.4; 428/72; 428/120; 428/180

[58] Field of Search ..... 5/441, 450, 455; 156/145, 147, 209, 210, 292, 308.4; 428/72, 120, 180

[56] References Cited

U.S. PATENT DOCUMENTS

| | | | |
|---|---|---|---|
| 3,849,814 | 11/1974 | Ross | 5/451 |
| 4,310,936 | 1/1982 | Benjamin | 5/451 |
| 4,517,691 | 5/1985 | Phillips | 5/450 |
| 4,523,343 | 6/1985 | Fraige | 5/451 |
| 4,547,919 | 10/1985 | Wang | 5/455 |
| 4,576,669 | 3/1986 | Caputo | 156/145 |
| 4,577,356 | 3/1986 | Johenning et al. | 5/451 |
| 4,607,404 | 8/1986 | Fraige | 5/451 |

OTHER PUBLICATIONS

"Ultra Sleep 100" a trade brochure of Monterey Mfg. Co., 12828 S. Broadway, Los Angeles, CA, 90061 ©1982.

*Primary Examiner*—Robert A. Dawson
*Attorney, Agent, or Firm*—Richard L. Myers

[57] ABSTRACT

A water mattress includes an outer bladder for retaining water and an inner chamber assembly for inhibiting wave motion within the bladder. The chamber assembly includes multiple chambers each having a bottom sheet and a closure sheet, and the bottom sheet being deformed to provide the bottom and sides of the chamber. Adjacent chambers are joined along a single seam to form the chamber assembly. In a preferred method, the bottom sheet is heated and drawn into a vacuum form where it is cooled to permanently deform the sheet into an integral, multiple chamber, seamless configuration.

4 Claims, 4 Drawing Sheets

FIG. 1.
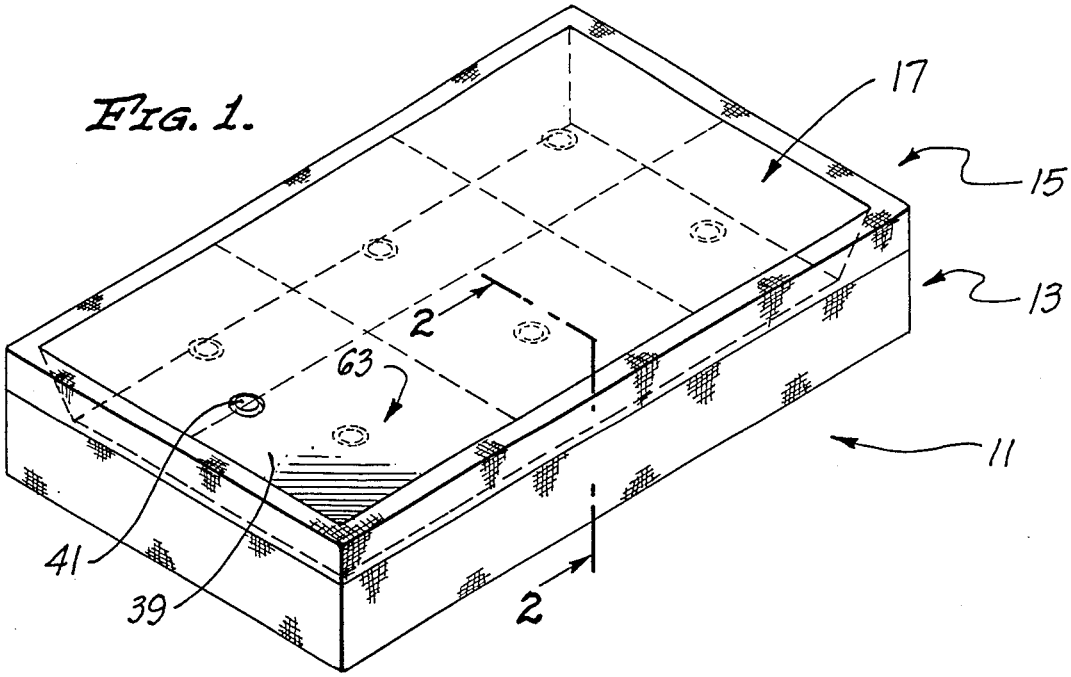
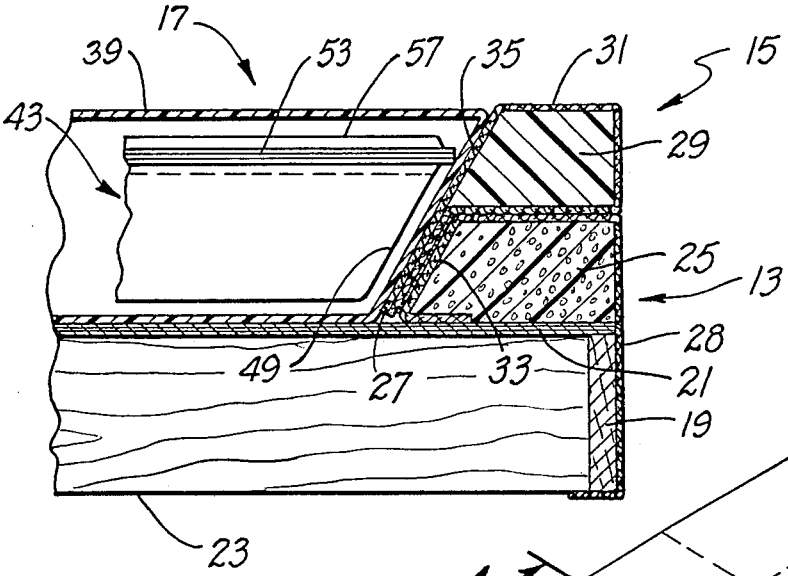
FIG. 2.
FIG. 3.
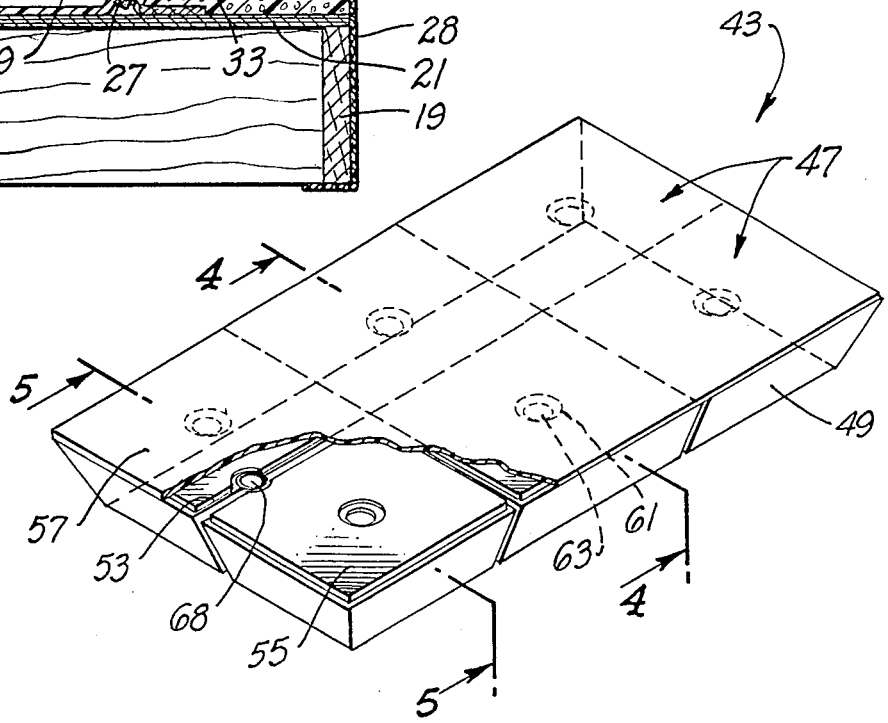

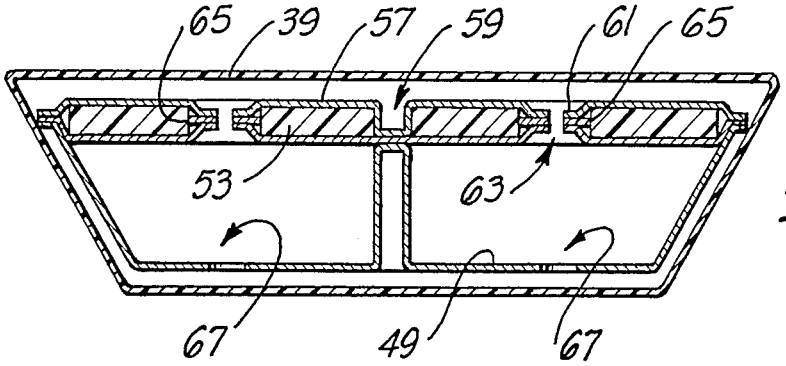
FIG. 4.
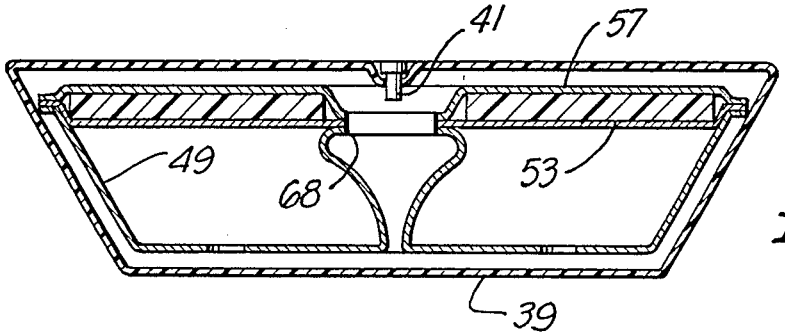
FIG. 5.
FIG. 6a.
(PRIOR ART)
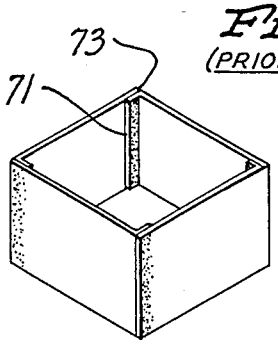
FIG. 6b.
(PRIOR ART)
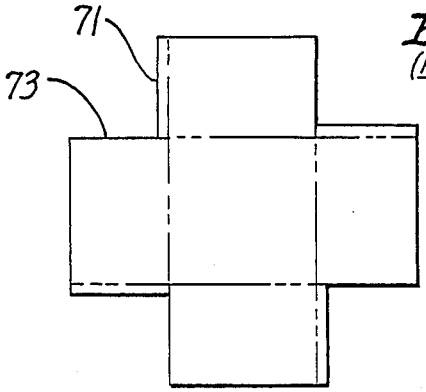
FIG. 6c.
(PRIOR ART)
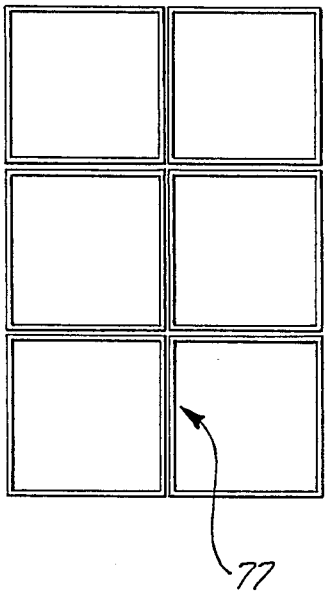

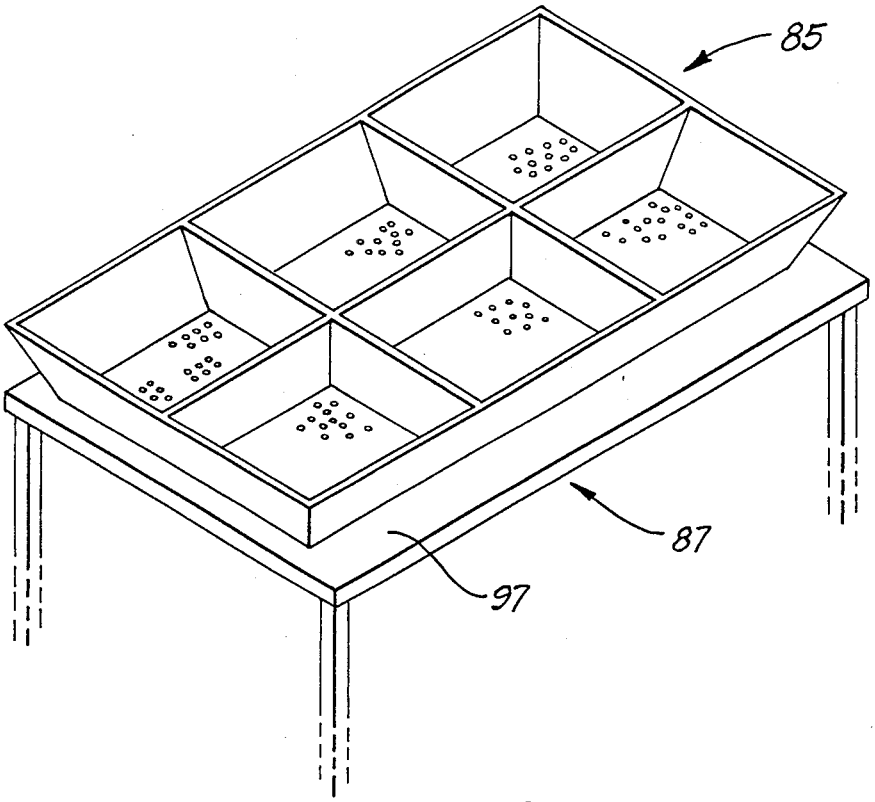
FIG. 7.
FIG. 8.
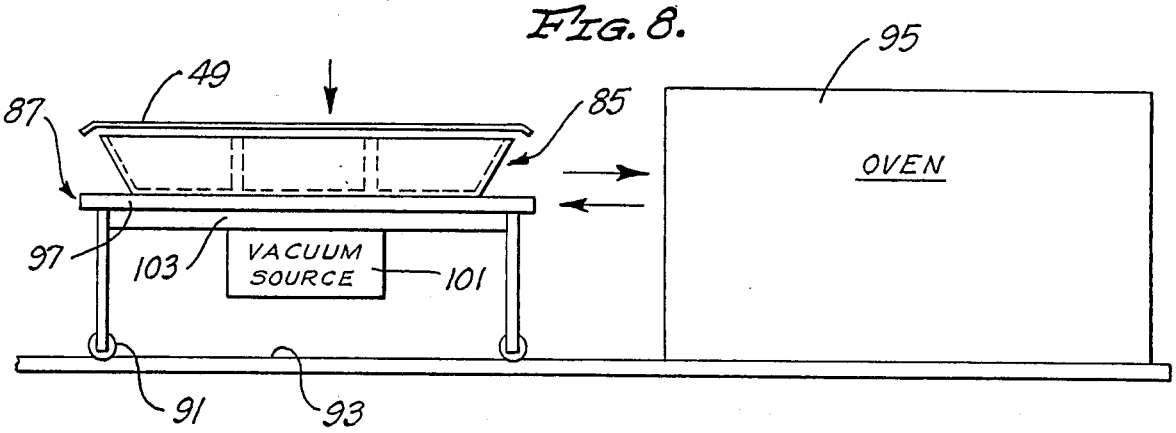
FIG. 10.
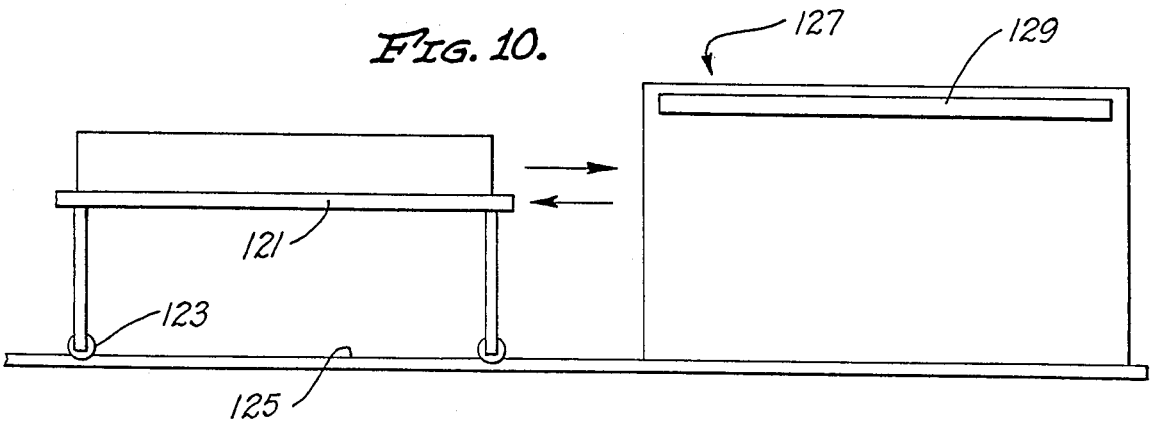

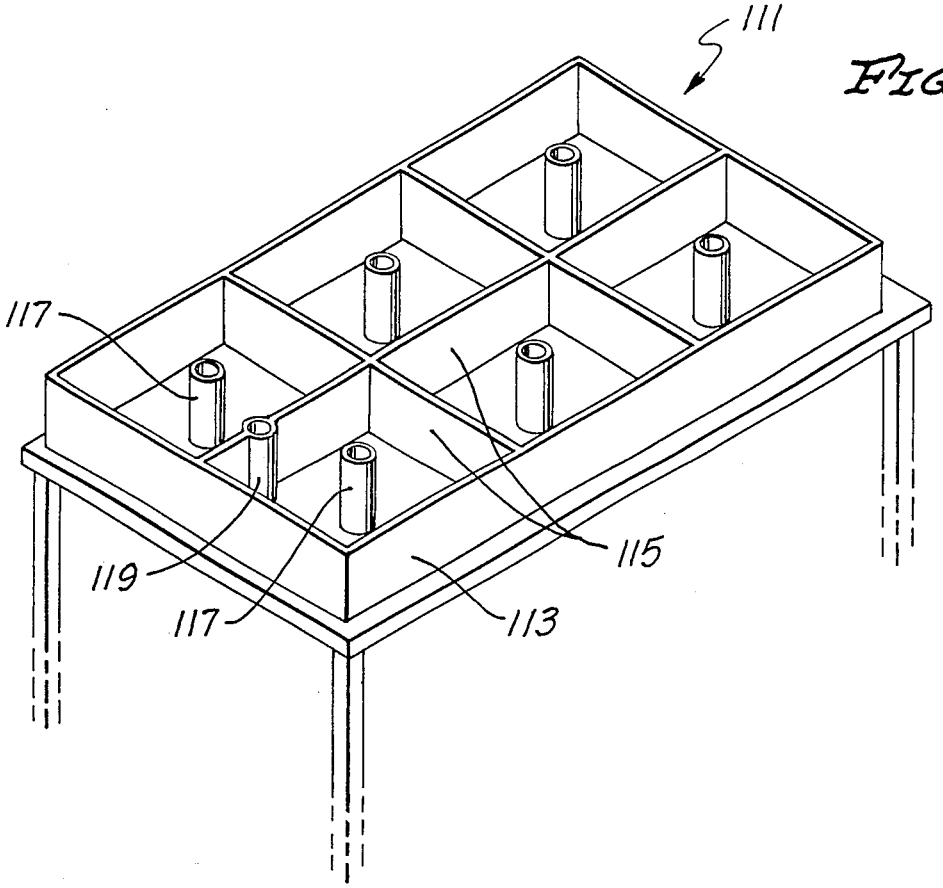
FIG. 9.
FIG. 11.
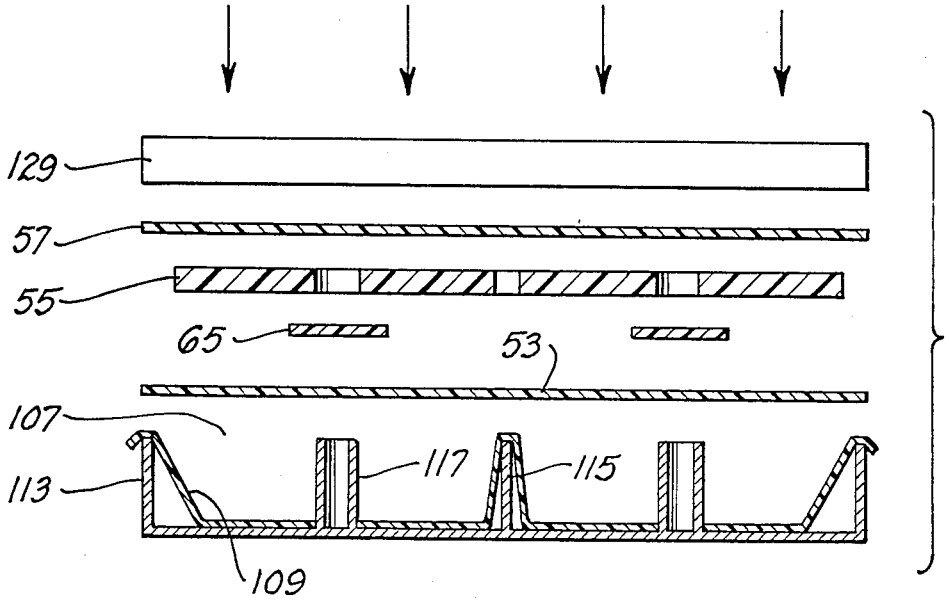

METHOD OF MAKING A WATER MATTRESS WITH HYDRAULIC CHAMBER ASSEMBLY

This application is a division, of application Ser. No. 728,761, filed 4/30/85 and now abandoned.

BACKGROUND

1. Field of the Invention

This invention relates generally to waterbed mattresses and more specifically to that type of mattress having interior hydraulic chambers for inhibiting wave motion and for providing a controlled release of water contents.

2. Discussion of the Prior Art

Water mattresses of the past have been adapted to two general types of waterbed assemblies. In one type of assembly, upstanding hardwood side panels support the mattress which is provided with generally square corners. In another type of construction, the waterbed is provided with foam panels which may have slanted side surfaces which support the sides of the waterbed mattress. This latter type of construction accommodates a mattress having slanted sides and is commonly referred to as hybrid waterbeds.

Each of these types of mattresses has been provided with an outer bladder which is adapted to contain the water. Disposed within that bladder is a hydraulic chamber assembly having multiple chambers each adapted to inhibit wave motion and to provide a controlled release of water from the chamber into the bladder. These chamber assemblies have been constructed with floating foam panels at an upper surface and sinking characteristics at a lower surface, in order to expand the chambers within the water. Openings between each chamber and the outer bladder have provided for the passage of water into and out of the chamber as a result of its expansion and contraction. The size of these openings has contributed to the "hardness" of the mattress when a person initially sits or lies on the bed.

Each of the chambers associated with the inner assembly have been formed in a generally rectangular configuration with bottom and side surfaces joined along multiple side seams. With these individual chamber members draped over a respective chamber die, the dies have then been individually moved into proximity and overlayed with a common closure sheet. Heatsealing the closure sheet to the individual chamber members has resulted in the combined assembly. As many as sixteen individual dies and four different types of dies have been required to form the chamber assembly. With this construction it has been necessary to form an entire top seam for each of the chambers in order to limit the number of sheets contributing to each seam. For chambers in juxtaposition, this has required two separate seams running closely parallel to each other in the assembly. This unfortunate double seam construction has demanded a wide separation of the floating foam panels. As a consequence, some undesirable bending and overlapping of the foam panels has resulted.

Another of the major problems associated with this construction has been the waste of material which has resulted from the individual formation of the chamber members. For example, material waste associated with the formation of a single chamber member has been as high as twenty-five percent. But perhaps the greatest disadvantage of this construction has been the tremendous amount of labor which has been required, not only to form the individual chamber members, but to align each of those members in a separate die and to further align as many as sixteen dies for the final chamber assembly. Perhaps insignificant with respect to these major considerations is the fact that it has always been desirable in waterbed construction to limit the number and length of seams which typically form the weakest sections of the mattress.

SUMMARY OF THE INVENTION

In accordance with the present invention, the hydraulic chamber assembly can be formed as an integral unit. A single piece of material having a size roughly equivalent to the ultimate length and width of the mattress, is draped over a vacuum form having the desired chamber configuration. This form is introduced to an oven where the sheet material is heated while air pressure is applied to draw and stretch the material into the vacuum form. Cooled in this configuration, that single sheet is permanently deformed to the shape desired for the bottom and side surfaces of the ultimate chamber assembly.

In its permanently deformed state, this base sheet of the chamber assembly can be loaded into a base die having a chamber configuration similar to that of the vacuum form. All of the chambers are accommodated in this single die which has only one die wall separating adjacent chambers. When the closure sheet is laid over this combination, a planar top die can be used to simultaneously form with the base die all of the heat seals associated with the chamber assembly. All of these seals lie in a single plane so that beneath the top sheet, the assembly is entirely seamless. Not only does this configuration provide a reduced length of seam, but more importantly, it provides a significant reduction in material waste. For example, with prior constructions, approximately 217 square feet of plastic was required whereas with the present method, only 139 square feet of material are needed for a king size, 16 chamber mattress.

Furthermore, the time required to manufacture the chamber assembly is reduced by as much as 60 percent. With past methods, a 16 chamber assembly would require approximately 40 minutes to form while this new construction method now requires only 16 minutes.

The resulting chamber assembly requires only a single seam between each of the chambers. This makes it possible to lay the foam panels in close proximity to each other and thereby inhibit twisting and overlapping.

These and other features and advantages associated with this concept will be more apparent to those skilled in the art with a description of preferred embodiments of the invention and reference to the associated drawings.

DESCRIPTION OF THE DRAWINGS

FIG. 1 is a perspective view of a waterbed of the hybrid type;

FIG. 2 is a cross-section view taken along lines 2—2 of FIG. 1 and illustrating the slant sides associated with the outer bladder and inner chamber assembly of the mattress;

FIG. 3 is a perspective view, partially in section, of the chamber assembly associated with one embodiment of the present invention;

FIG. 4 is a cross-sectional view of the chamber assembly taken along lines 4—4 of FIG. 3;

FIG. 5 is a cross-sectional view of the chamber assembly taken along lines 5—5 of FIG. 3;

FIG. 6A is a plan view of the sheet configuration required by chamber members of the prior art;

FIG. 6B is a perspective view of the bottom and side wall construction of the chamber members of the prior art;

FIG. 6C is a top plan view of the final die orientation associated with the prior art.

FIG. 7 is a perspective view of a vacuum form used in a preferred method of this invention;

FIG. 8 is a side schematic view of the vacuum forming step in a preferred method of construction;

FIG. 9 is a perspective view of the integral base die prior to receiving the deformed base sheet in a preferred method of the invention;

FIG. 10 is a side schematic view of the base die and top die associated with the heat sealing step; and FIG. 11 is a side assembly view of the base die showing the order of assembly of parts in the single heat sealing step of this invention.

DESCRIPTION OF PREFERRED EMBODIMENTS

A waterbed is illustrated in FIG. 1 and designated generally by the reference numeral 11. This waterbed 11 is of the hybrid type having a pedestal 13 and foam side panels 15 which are configured to receive a waterbed mattress 17. With reference to FIG. 2, it will be noted that the pedestal 13 can be formed from upstanding wood side supports 19 which are capped with a planar base support 21, such as pressed wood, and covered along the bottom with a fabric, such as a dust cover 23.

The foam side panels 15 include a foam riser 25 disposed on top of the base support 21. This riser 25, which is provided with a slanted interior surface 27, can be covered with border quilting 28 which extends down the riser 25 and along the side of the pedestal 13.

Also included in the side panels 15 is a foam bolster 29 which can be covered with a polytwill backing 31 beginning and ending along the slant surface 27 of the riser 25. This backing can be attached along the surface 27 using an extended length of hook and loop type fastener 33 such as that sold under the trademark Velcro.

The outer surface of the foam bolster 29 is coplanar with the sides of the riser 25 and the pedestal 13. An inner surface 35 of the bolster 29 is coplanar with the slant surface 27 of the riser 25. With this configuration, the support panel 21 and the slant surfaces 27 and 35 associated with the side panels 15, define a generally horizontal cavity for receiving the waterbed mattress 17.

Referring to FIGS. 1 and 2, a preferred embodiment of the mattress 17 is illustrated to include an outer bladder 39 which is formed of plastic sheet material which defines a container impervious to water. A fill tube 41 provides access to the bladder 39 and permits the filling and withdrawal of water. Disposed within the bladder 39 is a hydraulic chamber assembly 43 which is further illustrated in the prospective view of FIG. 3.

The chamber assembly 43 is comprised generally of a plurality of individual chambers 47 which are disposed in juxtaposition to each other. In the illustrated embodiment, which has six chambers 47, a base sheet 49 formed from a single piece of material provides both the bottom and side walls of each chamber 47. A closure sheet 53 forms a common top wall for each of the chambers 47. Individual polyethylene foam panels 55 are disposed above the closure sheet 53 and are provided with an area slightly smaller than the cross-sectional area of the chamber 47.

Finally, a top sheet 57 is provided to overlie the foam panels 55 and the closure sheet 53. This top sheet 57 is heat sealed to the closure sheet 53 and the base sheet 49 along a single seam which extends between the adjacent foam panels 55. This single seam is designated in FIG. 4 by the reference numeral 59. It will be noted that only three pieces of material are combined in the single seam 59 which separates the adjacent chambers 47.

In order to accommodate a flow of water into and out of the assembly 43, it is desirable to provide access from the bladder 39 into each of the chambers 47. For this reason, in the illustrated embodiment, a circular heat seal 61 joins the top sheet 57 and the closure sheet 53 and defines a top hole 63 which extends into the chamber 47. In order to provide the desired amount of material at the seal 59 around the top hole 63, it may be desirable to add a patch 65 of material between the closure sheet 53 and the top sheet 57.

In addition to the top hole 63, a bottom hole 67 can be formed in the base sheet 49 to similarly provide access between the bladder 39 and the chamber 47 illustrate assemblies which are associated with the mattresses of the prior art.

Referring now to FIG. 5, it will be noted that the chamber assembly 43 can be constructed so that a large void is formed in proximity to the fill tube 41 of the bladder 39. This void will insure that the chamber assembly 43 does not block the fill tube 41 as water is being removed from the mattress 17. In a preferred embodiment, a circular heat seal joins the base sheet 49, the closure sheet 53 and the top sheet 57 in proximity to the fill tube 41. The resulting seal, which is designated by the reference numeral 68, can be provided with a diameter such as five inches.

The pocket containing the foam panel 55 is preferably isolated from the water in the bladder 39 and the chambers 47. This isolation is provided not only by the seam 59 but also by the seal 61 which joins the top sheet 57 and the closure sheet 53 through an enlarged opening 69 in the foam panel 55. Forming the seal 61 through the opening 69 has been particularly advantageous in keeping the foam panel from bunching up or otherwise folding back on itself.

With the chamber assembly 43 is disposed in the water filled bladder 39, the foam panels 55 in their respective air pockets tend to cause the upper surface of the bladder assembly 43 to float. If the base sheet 49 of the assembly 43 is made of a polyethylene, its specific gravity which is greater than unity, will cause the bottom of the chamber assembly 43 to sink in the bladder 39. Thus, opposite top and bottom walls of the assembly 43 will tend to separate in the water. As this occurs, the water in the bladder 39 enters the holes 63 and 67 to occupy the volume of the chambers 47.

When an individual sits or lies on the waterbed 11, his weight will squeeze the chambers 47 and the water in the chambers will tend to exit through the holes 63 and 67. Depending upon the size of these holes, the time required to deflate the chamber 47 can be controlled. This of course affects the "hardness" of the mattress 17.

Also, since the chambers 47 function independently, a person sitting or lying on one area of the mattress 17 will not substantially affect the comfort of an individual sitting or resting on another portion of the mattress 17.

Of course the chamber assembly 43, by nature of its presence within the bladder 39, will naturally inhibit any wave motion which may occur within the bladder 39.

FIGS. 6A, 6B and 6C illustrate method steps and the resulting apparatus asociated with chamber assemblies of the prior art. As previously noted, each of the chambers in those assemblies were formed individually. Thus a sheet of plastic material having a generally square configuration was provided, and then the corners of the square were removed as illustrated in FIG. 6A. It is the removal of this corner material in the initial step of the process which accounts for the twenty-five percent waste associated with the prior art.

After each of the corners of this material was cut, for example, along the edges 71 and 73, these edges were heat sealed together to form a seal 75 at each corner of the chamber member. Problems well known in the industry relating to seal integrity were amplified in this construction, where as many as sixteen chamber members required as many as sixty-four corner seals in a given chamber assembly.

After the separate chamber members were formed, each was disposed in its respective base die and these dies were moved into proximity, as illustrated in FIG. 6C, for the final sealing step. It will be noted that in this orientation, parallel seams, shown generally at 77, are formed by each pair of adjacent dies.

Illustrated in FIGS. 7 through 11 are several of the steps associated with a preferred method for manufacturing the waterbed mattress 37. In an initial step, a vacuum form 85 is provided which has a shape roughly equivalent to that desired for the hydraulic chamber assembly 43. Thus in the illustrated embodiment, the vacuum form 85 is provided with slant sides and six chambers. This vacuum form 85 can be formed from wood panels and preferably is open at both the top and the bottom.

This form 85 is placed on top of a table 87 which is supported on rollers 91 which ride on rails 93. These rollers 91 and rails 93 permit the table 87 with the vacuum form 85 positioned thereon, to be moved into a large oven 95. In this particular method, the table 87 is of particular interest as it is provided with a perforated top member 97 and a large vacuum 101 having a manifold 103 which extends beneath a major portion of the top member 97. With this apparatus, the vacuum 101 attempts to draw air through the vacuum form 85 and the top member 97 into the manifold 103.

In the next step of this method, the base sheet 49 which ultimately forms the bottom and sides of the chambers 47 is positioned over the vacuum form 85. This sheet can have a thickness of 20 mils which is typical for the polyvinyl chloride material commonly used in waterbeds. However, as opposed to prior methods of manufacture, the base sheet 49 need only be of a length and width substantially equivalent to that ultimately desired for the waterbed mattress 17. There is practically no waste of material in the process of this invention. With this single sheet 49 positioned over the vacuum form 85, the table 87 can be moved along the rails 93 into the oven 95.

In the oven, the base sheet 49 is heated to a temperature that makes it soft and pliable. In this state, the vacuum 101 can be activated, drawing and stretching the heated sheet 49 into the vacuum form 85. With the edges of the sheet 49 attached to the top peripheral edges of the vacuum form 85, this sheet 49 takes the shape desired for the chambers 47. In order to permanently maintain the sheet 49 in this deformed state, the vacuum 101 is left running as the table 87 is removed to room temperature.

In a preferred method, the sheet 49 is heated to a temperature of 220° F. for approximately 25 seconds. Then the vacuum 101 is turned on as the table 87 is removed from the oven 95. When the vacuum 101 has run approximately 2 minutes, it can be shut off and the cooled, deformed sheet 49 can be removed from the form 85.

This vacuum forming step is important to the manufacture of the hydraulic chamber assembly 43. Not only is the amount of material needed to form the chambers 47 significantly reduced, but the entire bottom and sides of the chamber assembly 43 are formed in a single step. In addition, the slant sides desired for the chamber assembly 43 and the hybrid system, are automatically provided as a result of the shape of the vacuum form 85. Special side seams for heat seal dies are required. The single sheet 49 is automatically provided with the desired configuration, which in this embodiment has six separate cavities 107 which ultimately form the chambers 47. Furthermore, the slant sides which are desired for one embodiment of the mattress 17 are also provided. Of particular importance is the fact that this entire structure formed by the cavities 107, which ultimately forms the bottom and sides of the chamber assembly 43, has no seams which might otherwise provide points of weakness for the assembly 43.

Before going on to the next major step in the process, holes can be punched in the single sheet 49 at the bottom of each of the cavities 107. These will ultimately form the bottom holes 67 previously discussed with reference to FIG. 3. In the foregoing manner, the single base sheet 49 can be deformed and punched to produce what is commonly referred to as the cavity assembly 109.

Referring now to FIG. 9, a heat sealing die 111, commonly referred to as the base die, is provided with a chamber configuration similar to that of the vacuum form 85. It will be noted that the base die 111 can be formed in a conventional manner from half inch aluminum and provided with upstanding side walls 113 and dividers 115 having a height somewhat less than that desired for the depth of the chamber assembly 43. The upstanding side walls 113 need not be provided with the slant shape of the side walls associated with the vacuum form 85 as the primary purpose of the base die 111 is to form a single seam 59 on the seal 61 along the top of the chamber assembly 43.

The base die 111 can also be provided with upstanding cylinders 117 in each of the chambers of the die 111. These upstanding cylinders 117 are adapted to receive the bottom holes 67 as the cavity assembly 109 is positioned in the base die 111. This orientation is best illustrated in FIG. 9.

The base die 95 can also include a relatively large upstanding cylinder 119 having a diameter equivalent to that desired for the seal 68. In the same manner, the upstanding cylinders 97 can be provided with a diameter desired for the top holes 63.

The base die 111 and the cavity assembly 109 can be positioned on the top of a table 121 having rollers 123 which are adapted to move along rails 125 into a conventional radio frequency heat sealer 127. In this case, the heat sealer 127 incorporates a top die 129.

Prior to the heat sealing step, the cavity assembly 109 is overlaid with the closure sheet 53 which can have a typical thickness of 20 mils. For reasons which will become more apparent in later discussion, the patches 65 of 20 mil polyvinyl chloride are laid on top of the closure sheet 53 above each of the upstanding cylinders 117. Then the foam panels 55 can be disposed above the closure sheet 53 in each of the chambers 47 with the enlarged openings 69 positioned over the cylinders 117. It is desirable that these foam panels 55 have peripheral edges whcih are closely spaced to the walls 113 and dividers 115 of the die 111, but it should not extend over either the walls or the dividers in a manner that would inhibit formation of the heat seals. Likewise, it is important that openings 69 in the foam panels 55 be provided with sufficient size that the seal 61 can be formed by the upstanding cylinders 117 without interference from the foam panels 55.

In this embodiment of the mattress 17, a piece of 8 mil polyvinyl chloride material forms the top sheet 57 of the chamber assembly 43. This top sheet 57 is laid over the foam panels 55 in the final assembly.

With each of these items oriented over the base die 111, the table 121 can be moved along the rails 125 into the heat sealer 121 and beneath the top die 129 for the only heat step in the preferred method. In a conventional manner, this single heat sealing step forms all of the seals associated with the hydraulic chamber assembly 43. Thus the seam 59 is formed at both of the walls 113 and dividers 115 of the die 111, while the seals 61 and 68 are formed at the cylinders 117 and 119 respectively.

It has been found that the most desirable heat seal is formed from three pieces of sheet material as this number seems to provide enough plastic to flow into the region of the seal without offering so much plastic that it inhibits seal formation. Thus along the walls 113 and dividers 115 of the die 111, the three sheets of material are provided by those associated with the base sheet 49, the closure sheet 53 and the top sheet 57. It will be noted however, that in the area of the cylinders 97, the base sheet 49 of the cavity assembly 91 does not contribute to the seal. This is why the patches 65 are preferably added at this location.

It is of particular interest that the walls 113 and dividers 115 which separate the chambers 47, form single seals. This is highly desirable, not only to limit the length of seal in the chamber assembly 43, but also to permit the foam panels 55 to lie in close proximity to each other. The prior art double seam construction did not permit this close proximity and as a result the foam panels tended to shift and override each other.

When the entire hydraulic chamber assembly 43 has been completed, the outer bladder 39 can be formed around the assembly 43 in many conventional manners. In the particular illustrated embodiment which is adapted for use in a hybrid waterbed 11, this outer bladder 39 will need to be formed with the same slant corner configuration.

It is now been seen that major advantages can be attributed not only to the method but to the resulting product of this invention. With this method, the hydraulic chamber assembly 43 can be formed with a 36% reduction in material costs. There is almost no waste material with this process. In addition, there is a 60% savings in labor cost. Instead of forming each chamber 47 separately and providing a separate heat seal die for each chamber, now an entire chamber assembly 43 can be manufactured simultaneously. There is only a single heat sealing step required in the manufacture of the entire chamber assembly 43. Furthermore, all of the seams 57 and seals 61, 68 lie in the same plane so they can be formed at the same time.

The resulting mattress 17 has its own advantages. For example, there are no seals associated with the cavity assembly 109. This significantly reduces the probability that the chambers 49 will rupture. For the first time, an economic method can result in a chamber assembly 43 with slant sides to accommodate a hybrid waterbed such as that illustrated in FIG. 1.

Although these features and advantages have been described with reference to preferred embodiments and methods of construction, it will be noted that the concept of this invention can be applied in many other forms and processes. This is particularly true with respect to the vacuum form step which can achieve any desired configuration for any portion of a waterbed mattress, all depending upon the shape of the vacuum form 85. Thus, the ultimate mattress 17 can be provided with slant or squared sides as desired and can be formed with as many separate chambers 47 as required. The number and size of the top and bottom holes 63 and 67 respectively, can also be varied as desired. For these reasons, this description of preferred methods and embodiments should not limit the scope of this concept, which instead should be determined only with reference to the following claims.

I claim:

1. A method of making a water mattress comprising:

vacuum forming a first sheet of material to define a plurality of seamless cavities;

placing a closure sheet over the first sheet, individual bouyant members over the closure sheet in registry with the cavities, respectively and a top sheet over the bouyant members;

sealing the base sheet, closure sheet and top sheet together to form a seal which extends around each of the cavities to seal each of the cavities to thereby form a chamber assembly and to separately encapsulate the individual bouyant members with the seal forming not more than one seam between adjacent cavities; and providing a watertight bladder around the chamber assembly.

2. A method as defined in claim 1 including placing the first sheet in a base die having a plurality of upstanding walls defining receiving areas with the cavities being received in the receiving areas, respectively, and with the first sheet extending over the walls of the base die and carrying out said step of sealing using the base die.

3. A method as defined in claim 2 wherein there are openings in the first sheet and in the bouyant members with said openings being at said cavities, respectively, and said step of placing the first sheet includes placing the openings in the first sheet over upstanding members, respectively, of the base die such that the upstanding members project into said cavities, respectively, and sealing the closure sheet and top sheet using the upstanding members to form seals around the openings of the bouyant members, respectively.

4. A method as defined in claim 3 wherein the step of sealing to form seals around the openings includes sealing a patch between the closure sheet and the top sheet at one of the openings.

* * * * *